US008936099B2

(12) United States Patent
Hu

(10) Patent No.: US 8,936,099 B2
(45) Date of Patent: Jan. 20, 2015

(54) CAM MECHANISM FOR DOWNHOLE ROTARY VALVE ACTUATION AND A METHOD FOR DRILLING

(75) Inventor: Jianbing Hu, Houston, TX (US)

(73) Assignee: Smith International, Inc., Houston, TX (US)

( * ) Notice: Subject to any disclaimer, the term of this patent is extended or adjusted under 35 U.S.C. 154(b) by 656 days.

(21) Appl. No.: 13/020,451

(22) Filed: Feb. 3, 2011

(65) Prior Publication Data

US 2012/0199363 A1 Aug. 9, 2012

(51) Int. Cl.

| | |
|---|---|
| ***E21B 34/10*** | (2006.01) |
| ***E21B 21/10*** | (2006.01) |
| ***E21B 23/00*** | (2006.01) |
| ***E21B 10/32*** | (2006.01) |

(52) U.S. Cl.

CPC ..... *E21B 10/322* (2013.01); *E21B 21/103* (2013.01); *E21B 23/006* (2013.01)

USPC ..... 166/386; 166/331; 166/320

(58) Field of Classification Search

USPC ..... 166/331, 386, 320

See application file for complete search history.

(56) References Cited

U.S. PATENT DOCUMENTS

| | | | | |
|---|---|---|---|---|
| 4,114,704 | A | 9/1978 | Maurer et al. | |
| 2009/0194270 | A1 * | 8/2009 | Bissonnette et al. | 166/65.1 |
| 2009/0242199 | A1 | 10/2009 | Basmajian et al. | |
| 2010/0126715 | A1 | 5/2010 | Dithmar et al. | |
| 2010/0319927 | A1 | 12/2010 | Yokley et al. | |
| 2011/0127044 | A1 * | 6/2011 | Radford et al. | 166/373 |
| 2011/0284233 | A1 * | 11/2011 | Wu et al. | 166/321 |

OTHER PUBLICATIONS

International Search Report and Written Opinion of PCT Application No. PCT/US2012/023570 dated Aug. 1, 2012: pp. 1-8.

* cited by examiner

*Primary Examiner* — Catherine Loikith

(74) *Attorney, Agent, or Firm* — Osha Liang LLP

(57) ABSTRACT

A downhole tool including a cam housing disposed in a central bore of a sub; a cam piston having a cam track disposed in the cam housing; a rotary piston having a rotary valve and an auxiliary track disposed in the cam housing; a guide pin extending through the cam housing into the cam track having at least two return paths; and a position pin disposed on a cam flange and extending into the auxiliary track. Also, a method of actuating a downhole tool, the method including disposing the downhole tool in a wellbore, wherein the downhole tool comprises a cam piston and a rotary piston; providing a flow of fluid through a central bore of the downhole tool at a working flow rate; changing the flow of fluid through the central bore of the downhole tool to a trigger range, and rotating a rotary valve of the rotary piston.

14 Claims, 4 Drawing Sheets

CAM MECHANISM FOR DOWNHOLE ROTARY VALVE ACTUATION AND A METHOD FOR DRILLING

BACKGROUND

1. Field of the Invention

Embodiments disclosed herein relate generally to an actuation system for a downhole tool. In particular, embodiments disclosed herein relate to an actuation mechanism of a downhole tool to selectively open and close components of the tool.

2. Background Art

Embodiments disclosed herein relate generally to an actuation system for a downhole tool. In particular, embodiments disclosed herein relate to an actuation mechanism of a downhole tool to selectively open and close components of the tool.

BACKGROUND ART

In the drilling of oil and gas wells, concentric casing strings may be installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas may be reduced. Therefore, to increase the annular space for the cementing operation, and to increase the production flow area, it may be desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation may be reached with comparatively larger diameter casing, thereby providing more flow area for the production of oil and gas.

Various methods have been devised for passing a drilling assembly, either through a cased borehole or in conjunction with expandable casing, to enlarging the borehole. One such method involves the use of an expandable underreamer, which has basically two operative states. A closed or collapsed state may be configured where the diameter of the tool is sufficiently small to allow the tool to pass through the existing cased borehole, while an open or partly expanded state may be configured where one or more arms with cutters on the ends thereof extend from the body of the tool. In the latter position, the underreamer enlarges the borehole diameter as the tool is rotated and lowered in the borehole. During underreaming operations, depending upon operational requirements of the drilling assembly, cutter blocks of the underreamer may be extended or retracted while the assembly is downhole.

Movement of the cutter blocks typically involves manipulating a sleeve that is used to open or close ports to allow fluid to activate and expand the cutter blocks of the underreamer. In certain prior art applications, the sleeve is held in place with shear pins, and a ball drop device may be used to shear the pins and thereby increase pressure in the tool to move the sleeve and open the cutter block activation ports. However, once the pins are sheared, the tool stays open for the duration of the drilling interval. Therefore, such a configuration may only allow one open cycle. This is also applicable in other tools which may be expanded, including but not limited to, cutting tools, spearing tools, and expandable stabilizers.

Accordingly, there exists a need for an apparatus to allow the components of expandable tools to open and close multiple times while the tool is downhole.

SUMMARY OF THE DISCLOSURE

In one aspect, embodiments disclosed herein relate to a downhole tool including a cam housing disposed in a central bore of a sub; a cam piston having a cam track disposed in the cam housing; a rotary piston having a rotary valve and an auxiliary track disposed in the cam housing; a guide pin extending through the cam housing into the cam track; and a position pin extending through a cam flange into the auxiliary track.

In another aspect, embodiments disclosed herein relate to a method of actuating a downhole tool, the method including disposing the downhole tool in a wellbore, wherein the downhole tool comprises a cam piston and a rotary piston; providing a flow of fluid through a central bore of the downhole tool at a working flow rate; changing the flow of fluid through the central bore of the downhole tool to a trigger range, thereby rotating a rotary valve of the rotary piston.

In another aspect, embodiments disclosed herein relate to a method of drilling, the method including disposing a downhole tool in a wellbore in an uncompressed position, the downhole tool comprising a cam piston and a rotary piston, the rotary piston having a rotary valve; providing a flow of fluid to the downhole tool, wherein the flow of fluid moves the cam piston axially downward, rotating the rotary valve, wherein rotating the rotary valve places the downhole tool in a compressed position; drilling formation with the downhole tool in a compressed position.

Other aspects and advantages of the invention will be apparent from the following description and the appended claims.

DETAILED DESCRIPTION

In one aspect, embodiments disclosed herein relate generally to apparatuses and methods for actuating a downhole tool. More specifically, embodiments disclosed herein relate to apparatuses and methods allowing multiple actuation cycles without having to trip a tool. More specifically still, embodiments disclosed herein relate to apparatuses and methods allowing for the unlimited activation and deactivation of downhole tools, such as reamers.

During drilling operations, a reamer may be run in hole on a drill string with a drill bit located on the distal end of the drill string. The drill bit may be used to drill a portion of the wellbore, then, at a select location, a reamer may be activated to increase the diameter of the wellbore. Activation of the reamer typically occurs by standard ball drop methods, which activates the tool so long as a sufficient flow of fluids are pumped downhole. When the flow of fluids is turned off, the tool becomes inactive.

Embodiments of the present application provide an activation/deactivation system that allows the tool, such as a reamer, to be activated or deactivated numerous times. For example, embodiments of the present application may allow a drilling tool assembly having a reamer disposed on the drill string with a drill bit on the distal end of the drill string to be run in hole. The drill bit may be used to drill a portion of the wellbore, then the reamer may be activated to widen the wellbore at a specific location. Then, the reamer may be deactivated, and the drill bit may be used to drill another portion of the wellbore. Alternatively, the reamer may be cycled on and off at various sections of the wellbore to either ream while drilling, or otherwise provide for stabilization of the wellbore during drilling operations. Thus, the actuation system described below may allow for multiple on/off cycles of one or more tools disposed on a drill string.

Figure 1:
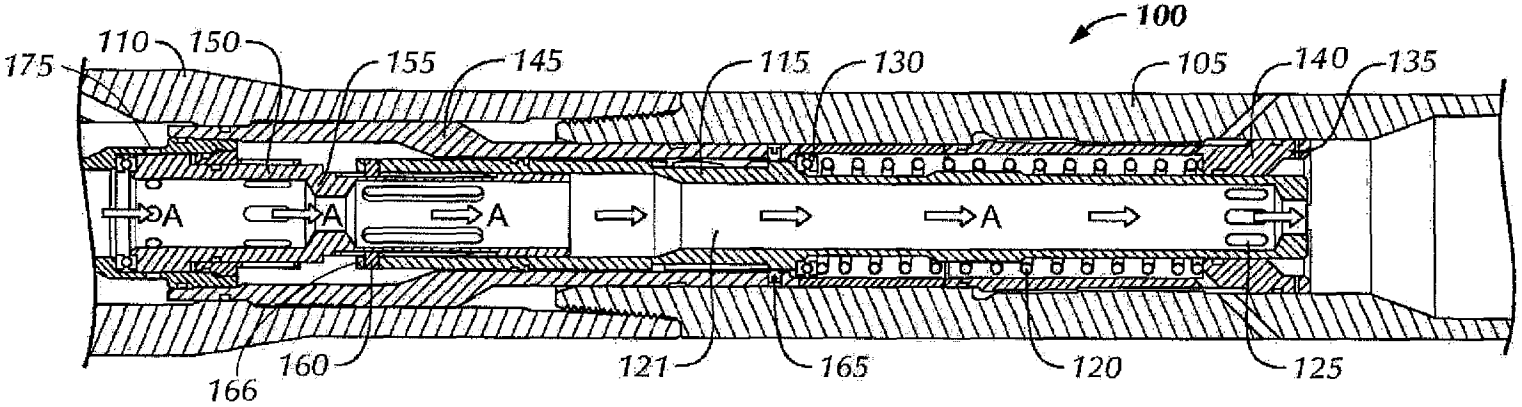
FIG. 1 is a cross-sectional view of a downhole tool according to embodiments of the present disclosure.

Referring initially to FIG. 1, a cross-sectional view of a downhole tool in an uncompressed position accordingly to embodiments of the present disclosure is shown. In this embodiment, downhole tool 100 is illustrated as including a sub 105 threadingly connected to a reamer body 110. Sub 105 includes a cam piston 115 disposed through a central throughbore 121 of downhole tool 100. Cam piston 115 is disposed axially above and partially surrounded by a spring 120. As illustrated, in the position of downhole tool 100 illustrated in FIG. 1, spring 120 is in a biased, uncompressed condition. Cam piston 115 further includes pressure signal slots 125 disposed at a distal end thereof. Those of ordinary skill in the art will appreciate that the number and orientation of pressure signal slots 125 may vary according to the requirements of a particular downhole tool 100. As illustrated, spring 120 abuts cam piston 115 at a piston shoulder 130.

Cam piston 115 is also disposed in a lower cap 135, which is disposed in central throughbore 121 of downhole tool 100. Lower cap 135 houses both spring 120 and cam piston 115, and includes a solid portion 140 that prevents fluid from flowing through pressure signal slots 125 when the downhole tool is in an uncompressed condition.

Downhole tool 100 further includes a cam housing 145 disposed partially in sub 105 and partially in reamer body 110. Cam housing 145 is located in central throughbore 121 and around cam piston 115. A rotary piston 150 is also disposed partially in cam housing 145. Rotary piston 150 includes a rotary valve 155, which is configured to rotate to change the direction of flow through central throughbore 121. As illustrated in FIG. 1, rotary valve 155 is in a closed position, causing the fluid to flow in direction A.

Downhole tool 100 further includes a position pin 160 that is attached to cam piston 115. However, depending on the requirements of the design, position pin 160 may alternatively be disposed on rotary valve 155. In certain embodiments, an auxiliary track and position pin 160 may be in reversed locations, such that position pin 160 may be disposed on the rotary valve and the auxiliary track may be disposed on the cam piston 115. As illustrated, position pin 160 extends through a cam flange 166 to the auxiliary track. Position pin 160 is configured to engage an auxiliary track (not shown) of rotary piston 150, which will be discussed in detail below. Downhole tool 100 also includes a guide pin 165 that extends from the cam housing 145 into engagement with cam piston 115. As with the position pin 160, depending on the particular design requirements, the guide pin 165 may alternatively extend from another portion of downhole tool 100. Guide pin 165 is configured to engage a cam track (not shown) of cam piston 115, which will be discussed in detail below.

Figure 2:
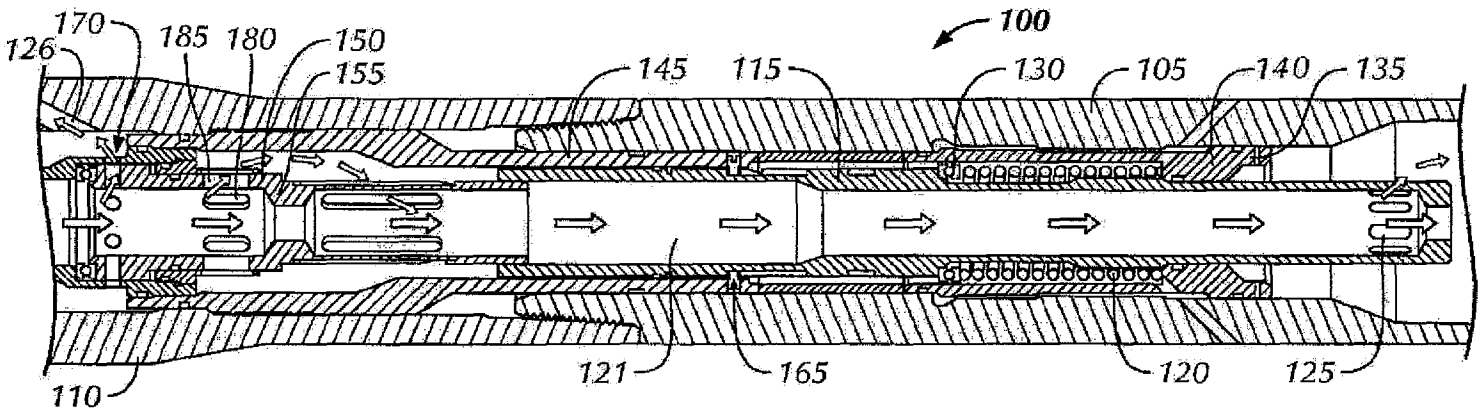
FIG. 2 is a cross-sectional view of a downhole tool according to embodiments of the present disclosure.

Referring now to FIG. 2, a cross-sectional view of a downhole tool in a compressed position accordingly to embodiments of the present disclosure is shown. FIG. 2 illustrates the same elements as FIG. 1; however, FIG. 2 illustrates the tool in a compressed, active, state. In the compressed state, cam piston 115 has moved axially downward, compressing spring 120. When cam piston 115 moves axially downward, fluid flow may pass through pressure signal slots 126, thereby alerting an operator that downhole tool 100 is in a compressed state. As cam piston 115 moved axially downward, rotary valve 155 of rotary piston 150 rotated, such that openings 170 in rotary valve 155 aligned with ports 175 of reamer body 110, and opening 180 of rotary piston 150 aligned with ports 185 of cam housing 145, thereby allowing fluid to exit into reamer body 110 and cam housing 145, respectively. Openings 180 of rotary piston 150 may be additional pressure signal slots, thereby allowing an operator to know the downhole tool 100 is in a compressed state.

In the compressed state, fluid is allowed to flow into reamer body 100, thereby causing blocks (not shown) of the reamer to radially expand. Additionally, the flow of fluid through cam housing 145 and out pressure signal slots 126 may be monitored by an operator to access the condition of the downhole tool 100.

Figure 3:
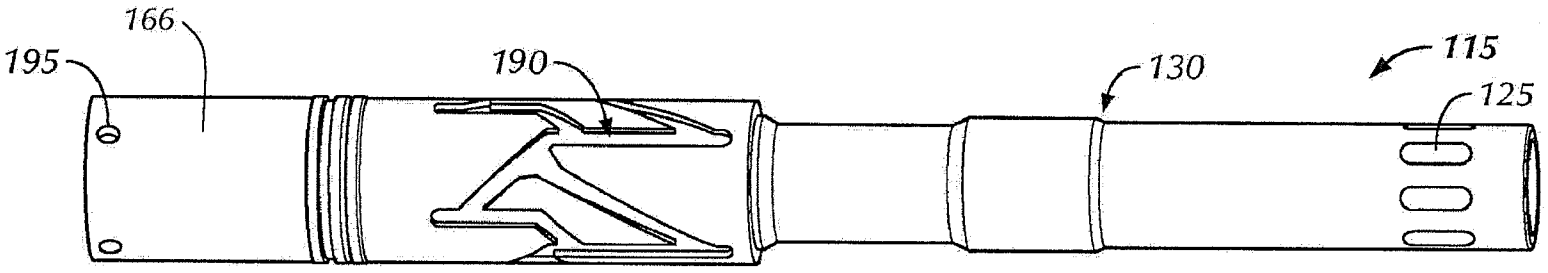
FIG. 3 is a side view of a cam piston according to embodiments of the present disclosure.

Referring to FIG. 3, a side view of a cam piston according to embodiments of the present disclosure is shown. In this embodiment, cam piston 115 is illustrated having a cam track 190, a shoulder 130, and pressure signal ports 125. Cam piston 115 also includes position pin slots 195 that are configured to receive a position pin, which will be explained in detail below. Those of ordinary skill in the art will appreciate that geometry of cam track 190 may vary and the cam track pattern may vary based on the requirements of a particular downhole tool.

Figure 4:
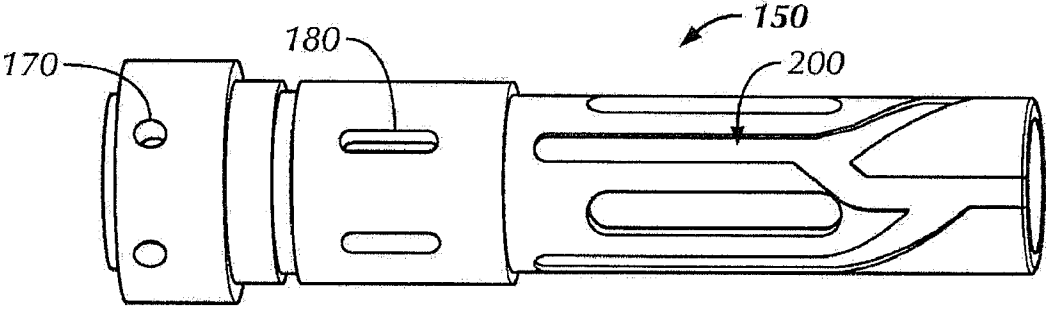
FIG. 4 is a side view of a rotary piston according to embodiments of the present disclosure.

Referring to FIG. 4, a side view of a rotary piston according to embodiments of the present disclosure is shown. In this embodiment, rotary piston 150 includes an auxiliary track 200, pressure signal ports 180, and opening 170. The auxiliary track 200 is configured to engage a position pin, as is described in detail below. Those of ordinary skill in the art will appreciate that geometry of auxiliary track 200 may vary and the auxiliary track pattern may vary based on the requirements of a particular downhole tool.

Embodiments of downhole tools of the present disclosure are configured to allow for rotation of a rotary valve between open and closed positions by rotation, as a result of a particular hydraulic pressure signal. Thus, varying the hydraulic pressure flowing through the downhole tool will allow other tools, such as reamers, stabilizers, and the like to be actuated multiple times. In order to allow for the multiple actuation cycles, the downhole tool has cam tracks and auxiliary tracks, as discussed above.

Figure 5:
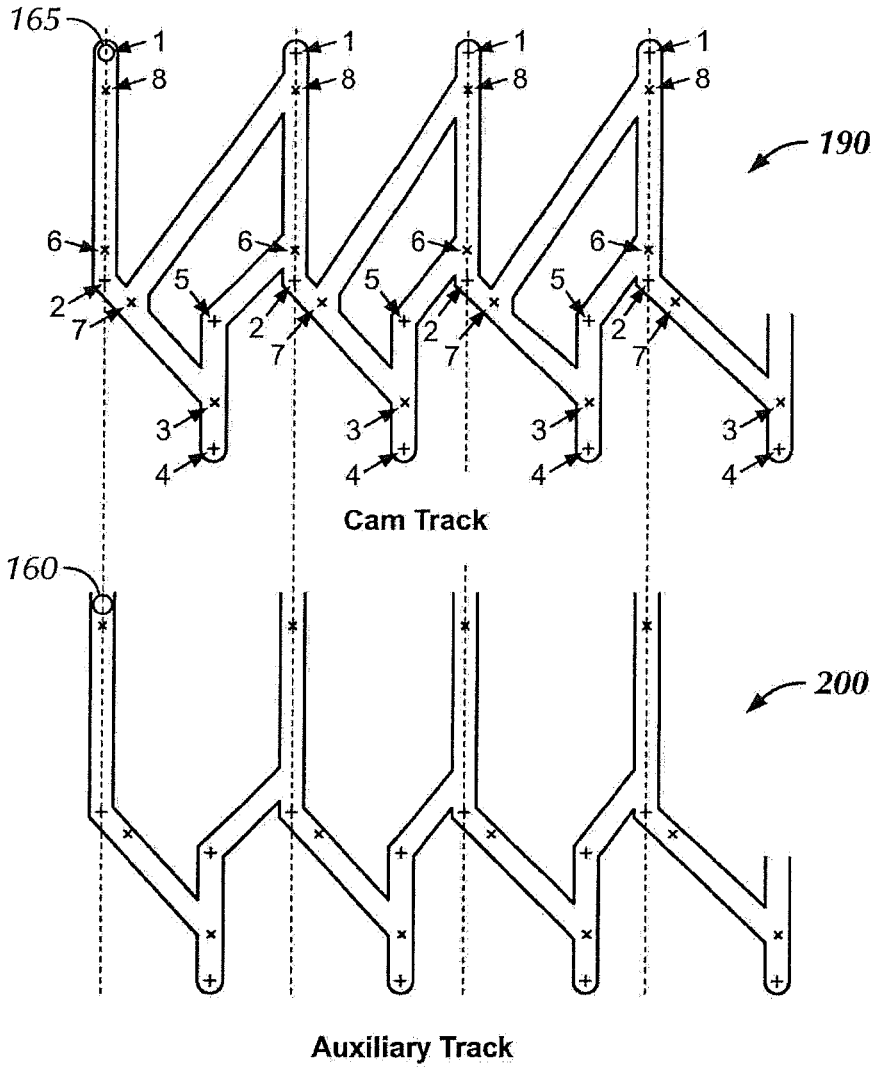
FIG. 5 is a schematic representation of a cam track and auxiliary track according to embodiments of the present disclosure.

Referring to FIG. 5, a schematic of a cam track and auxiliary track according to embodiments of the present disclosure is shown. In this embodiment, cam track 190 is illustrated in a plan layout, showing guide pin 165 disposed in a first position. During normal operation guide pin 165 follows along cam track 190 between positions 1, 2, 3, and 4. Thus, in a single cycle, whether fluid is not flowing or fluid is flowing at a maximum rate, the guide pin follows the cam track between positions 1, 2, 3, and 4. FIG. 5 also illustrates auxiliary track 200 in a plan layout, showing position pin 160 disposed in a first position. As may be seen from the track patterns, cam track 190 and auxiliary track 200 correspond between points 1, 2, 3, and 4. Thus, during a normal working cycle, as guide pin 165 moves in cam track 190, position pin will move in auxiliary track 200. So, for example, when hydraulic flow goes from point 1, which represents zero flow, to point 2, which represents high flow, and then stays at high flow to point 3 and ends up at point 4, the valve stays in its current position, either open or closed the entire time. However, when the hydraulic flow rate changes to a trigger range and drops to, for example point 5 to 6, or any point between 7 and 3, then to point 7 to 8, the cam will rotate the rotary valve in the rotary piston and change the open/close status.

Thus, during working cycles (movement from 1, 2, 3, 4, 5, 6, and 1), the cam piston rotates but the rotary valve stays stationary, thus resulting in the downhole tool being in either an active or inactive state. When the rotary piston is triggered by changing flow rates (movement from 1, 2, 7, 8, and 1), the rotary valve is rotated and the downhole tool changes from either an active to inactive state or from an inactive to an active state.

The rotation of the rotary valve is a result of cam track 190 and auxiliary track 200 not corresponding at all locations. For example, because auxiliary track does not have a path that corresponds with the path on cam track between points 7 and 8, rotary valve will turn, thereby either activating or deactivating the downhole tool.

During a working cycle a downhole tool may be run into a wellbore with no flow and guide pin at position 1. Once downhole, a first operation is commenced that does not require actuation of, for example a reamer, which is operatively connected to activate or deactivate according to the rotary valve. Full flow is started, which moves the guide pin from 1 to 2 to 3 to 4, and then to 5 to 6, and back to 1. In such a cycle, whether flow is zero or full flow, the reamer, in this example, did not activate. When it is desirable to activate the reamer, flow is adjusted so that the guide pin is in a position between points 7 and 3. The guide pin will then follow path 7 to 8 to 1, for which auxiliary track 200 has no corresponding track pattern. The differences in the track patterns will thereby rotate the rotary valve activating the reamer. Flow may then be increased and a normal work flow may be used, with the reamer in an expanded position so that a wellbore may be expanded. Multiple working cycles may be used until it is desirable to deactivate the reamer, at which point flow is increased to position the guide pin 165 between points 7 and 3, which will cause the pin 165 to follow from 7 to 8 to 1, thereby rotating the rotary valve into a closed position and deactivating the tool.

Figure 6:
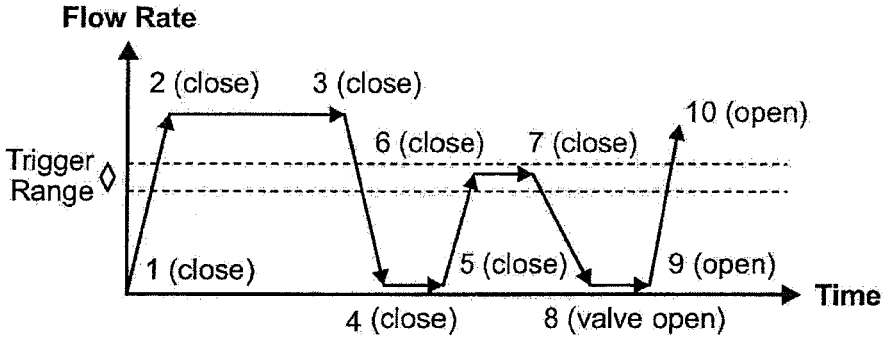
FIG. 6 is a graph showing the affect of flow rate on the status of a downhole tool according to embodiments of the present disclosure.

Referring to FIG. 6, an alternative graphical representation showing the affect of flow rate on the status of a downhole tool according to embodiments of the present disclosure is shown. As illustrated, the tool may initially be in an inactive position with the valve closed, at point 1. Flow may then be increased over the trigger range to a full flow position, at point 2. At point 2, even during full flow, the valve stays closed and the tool remains in an inactive position. The flow rate may continue at full flow to point 3, while the valve remains closed, and then flow stopped, when passes through the trigger range, but the valve remains closed at point 4. The valve remains closed at point 5, until the flow is increased into the trigger range at point 6, where the valve remains closed through point 7, until the flow is decreased between point 7 and 8, opening the valve. The valve then stays open whether there is fluid flow or not, and a tool may be activated by increase flow with the valve in the open position, as indicated by increase the flow from point 9 to point 10.

Figure 7A:
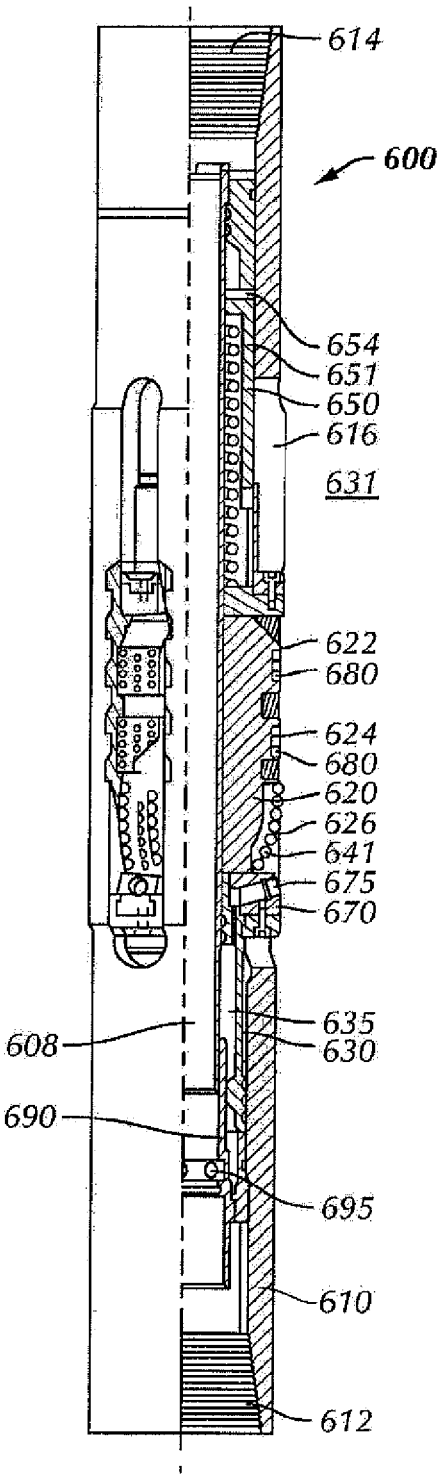
FIG. 7A is a partial cross-sectional view of an inactive reamer according to embodiments of the present disclosure.
Figure 7B:
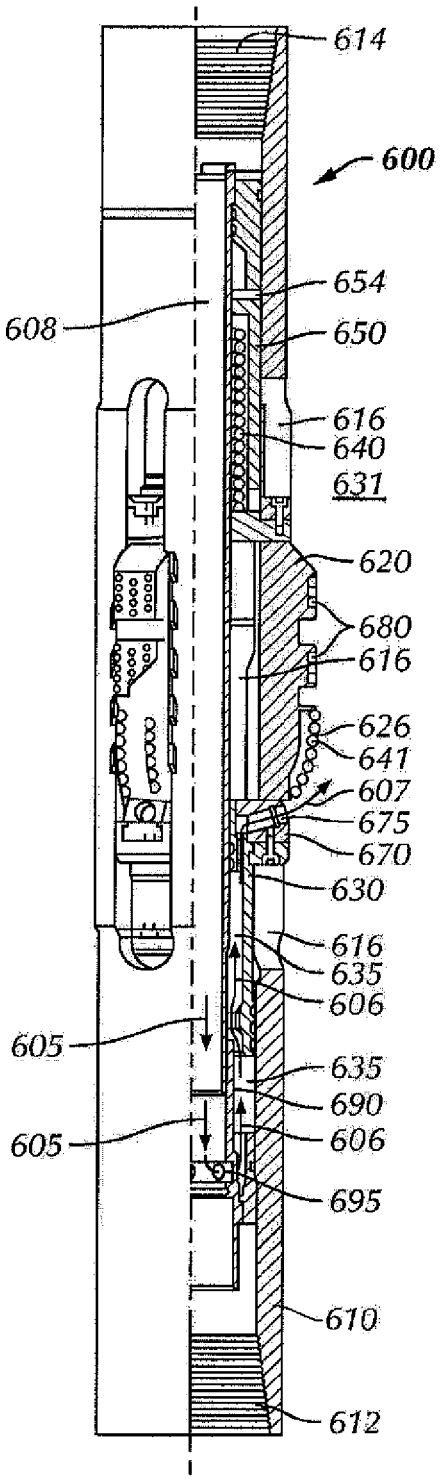
FIG. 7B is a side view of an engagement profile in a first position according to embodiments of the present disclosure.

Referring to FIGS. 7A and 7B, an expandable tool, which may be used in embodiments of the present disclosure, generally designated as 600, is shown in a collapsed position in FIG. 7A and in an expanded position in FIG. 7B. The expandable tool 600 comprises a generally cylindrical tubular tool body 610 with a flowbore 608 extending therethrough. The tool body 610 includes upper 614 and lower 612 connection portions for connecting the tool 600 into a drilling assembly. In approximately the axial center of the tool body 610, one or more pocket recesses 616 are formed in the body 610 and spaced apart azimuthally around the circumference of the body 610. The one or more recesses 616 accommodate the axial movement of several components of the tool 600 that move up or down within the pocket recesses 616, including one or more moveable, non-pivotable tool arms 620. Each recess 616 stores one moveable arm 620 in the collapsed position.

FIG. 7B depicts the tool 600 with the moveable arms 620 in the maximum expanded position, extending radially outwardly from the body 610. Once the tool 600 is in the borehole, it is only expandable to one position. Therefore, the tool 600 has two operational positions—namely a collapsed position as shown in FIG. 7A and an expanded position as shown in FIG. 7B. However, a spring retainer 650, which is a threaded sleeve, may be adjusted at the surface to limit the full diameter expansion of arms 620. Spring retainer 650 compresses a biasing spring 640 when the tool 600 is collapsed, and the position of the spring retainer 650 determines the amount of expansion of the arms 620. Spring retainer 650 is adjusted by a wrench in a wrench slot 654 that rotates the spring retainer 650 axially downwardly or upwardly with respect to the body 610 at threads 651.

In the expanded position shown in FIG. 7B, the arms 620 will either underream the borehole or stabilize the drilling assembly, depending on the configuration of pads 622, 624 and 626 and the expanded diameter of the tool. In FIG. 7B, cutting structures 641 on pads 626 are configured to underream the borehole. Depth of cut limiters (i.e., depth control elements) 680 on pads 622 and 624 provide gauge protection as the underreaming progresses. Hydraulic force causes the arms 620 to expand outwardly to the position shown in FIG. 6B due to the differential pressure of the drilling fluid between the flowbore 608 and the annulus 631.

The drilling fluid flows along path 605, through ports 695 in lower retainer 690, along path 610 into the piston chamber 635. The differential pressure between the fluid in the flowbore 608 and the fluid in the borehole annulus 631 surrounding tool 600 causes the piston 630 to move axially upwardly from the position shown in FIG. 7A to the position shown in FIG. 7B. A small amount of flow can move through the piston chamber 635 and through nozzles 675 to the annulus 631 as the tool 600 starts to expand. As the piston 630 moves axially upwardly in pocket recesses 616, the piston 630 engages the drive ring 670, thereby causing the drive ring 670 to move axially upwardly against the moveable arms 620. The arms 620 will move axially upwardly in pocket recesses 616 and also radially outwardly as the arms 620 travel in channels 518 disposed in the body 610. In the expanded position, the flow continues along paths 605, 606 and out into the annulus 631 through nozzles 675. Because the nozzles 675 are part of the drive ring 670, they move axially with the arms 620. Accordingly, these nozzles 675 are optimally positioned to continuously provide cleaning and cooling to the cutting structures 641 disposed on surface 626 as fluid exits to the annulus 631 along flow path 607.

The underreamer tool 600 may be designed to remain concentrically disposed within the borehole. In particular, tool 600, in one embodiment, preferably includes three extendable arms 620 spaced apart circumferentially at the same axial location on the tool 610. In one embodiment, the circumferential spacing may be approximately 120 degrees apart. This three-arm design provides a full gauge underreaming tool 600 that remains centralized in the borehole. While a three-arm design is illustrated, those of ordinary skill in the art will appreciate that in other embodiments, tool 610 may include different configurations of circumferentially spaced arms, for example, less than three-arms, four-arms, five-arms, or more than five-arm designs. Thus, in specific embodiments, the circumferential spacing of the arms may vary from the 120-degree spacing illustrated herein. For example, in alternate embodiments, the circumferential spacing may be 90 degrees, 60 degrees, or be spaced in non-equal increments. Accordingly, the secondary cutting structure designs disclosed herein may be used with any secondary cutting structure tools known in the art.

Advantageously, embodiments of the present application may allow for multiple activation/deactivation cycles for downhole tools, thereby allowing tools to be incrementally turned on and off by varying a flow of fluids through the actuation sub. As the cam piston provides for the different modes of operation, the number of activation and deactivation cycles are unlimited.

Also advantageously, as the apparatuses and methods do not rely on electronics, there is less chance of the tool interfering with other downhole tools, such as measurement-while-drilling or logging-while-drilling tools. Additionally, the lack of electronics may increase reliability of the tool, as electronics may fail in hard conditions, such as those experienced downhole.

Of further advantage, embodiments of the present application allow for full fluid flow to reach downhole components whether the tool is in active or inactive mode. Thus, the actuation sub may allow multiple activation/deactivation cycles allowing for drilling, reaming, and/or drilling while reaming, as needed during the drilling operation. Such methods may thereby decrease the need of costly trips of the drillstring, thereby decreasing time and expenditure during the drilling process.

In activating a downhole tool, such as a reamer, discussed above, a operator may initially dispose a downhole tool in a wellbore. The operator may subsequently provide a flow of fluid through the central bore of the downhole tool a working flow rate. Examples of working flow rates may include any rate of fluid flow up to a maximum for the tool and/or operation. The fluid flow rate is then changed to a trigger range, thereby rotating a rotary valve of the rotary piston. The rotation of the rotary valve thereby allows a flow of fluid to be diverted and places the downhole tool in an active state. Fluid flow rate may then be changed against to a working flow rate, thereby allowing an operation, such as reaming, to begin.

In another embodiment, a downhole tool may be disposed in a wellbore in an uncompressed position, such that, for example, the blocks of an expandable reamer are in an inactive state. A flow of fluid may then be provided to the downhole tool, moving a cam piston axially downward resulting in rotation of the rotary valve. The rotation of the valve may thereby place the downhole tool in a compressed position, provided a fluid flow to the reamer causing the blocks of the reamer to radially expand. Once in the expanded/compressed position, formation may be drilled with the reamer.

Advantageously, embodiments of the present application including an actuation sub may be used on various downhole tools. Examples of such tools include reamers, underreamers, stabilizers, secondary drilling tools, and the like.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A downhole tool comprising:

a cam housing disposed in a central bore of a sub;

a cam piston disposed in the cam housing, the cam piston having a cam track having at least two return paths in each of one or more cycles;

a rotary piston having a rotary valve and an auxiliary track disposed in the cam housing;

a guide pin extending through the cam housing into the cam track; and a position pin disposed on a cam flange and extending into the auxiliary track.

2. The downhole tool of claim 1, further comprising a spring disposed around the cam piston.

3. The downhole tool of claim 1, further comprising pressure signal slots disposed at a distal end of the cam piston.

4. The downhole tool of claim 1, further comprising valve openings disposed in the rotary piston.

5. The downhole tool of claim 1, further comprising pressure signal slots disposed in the rotary piston.

6. The downhole tool of claim 1, wherein the guide pin is configured to move along the cam track and wherein the position pin is configured to move along the auxiliary track.

7. The downhole tool of claim 6, wherein the cam track and the auxiliary track have different track patterns.

8. The downhole tool of claim 1, wherein the downhole tool comprises a reamer.

9. A method of actuating a downhole tool, the method comprising:

disposing the downhole tool in a wellbore, wherein the downhole tool comprises a cam piston and a rotary piston having a rotary valve in a first position;

providing a flow of fluid through a central bore of the downhole tool at a working flow rate;

changing the flow of fluid through the central bore of the downhole tool to a trigger range, thereby rotating the rotary valve to a second position, wherein the rotary valve remains in the second position while adjusting the flow of fluid within the trigger range; and adjusting the flow of fluid out of the trigger range to select a return path, thereby rotating the rotary valve.

10. The method of claim 9, wherein adjusting the flow of fluid radially expands a cutter arm of a reamer.

11. The method of claim 9, wherein the rotary piston is stationary at the working flow rate.

12. The method of claim 9, wherein the downhole tool further comprises a cam track and an auxiliary track, wherein a guide pin is disposed in the cam track and a position pin is disposed in the auxiliary track.

13. The method of claim 12, further comprising moving the guide pin in the cam track and moving the position pin in a corresponding track pattern of the auxiliary track when the flow of fluid is at the working flow rate.

14. The method of claim 13, further comprising moving the guide pin in the cam track and moving the position pin in a non-corresponding track pattern of the auxiliary track when the flow of fluid is in the trigger range.

* * * * *